US005996494A

United States Patent [19]

McEachern

[11] Patent Number: 5,996,494

[45] Date of Patent: Dec. 7, 1999

[54] GUIDE PIN MOUNTING FOR A PRINTING PLATE CYLINDER

[75] Inventor: David A. McEachern, St. Paul, Minn.

[73] Assignee: T.W. Wright, Inc., St. Paul, Minn.

[21] Appl. No.: 09/181,486

[22] Filed: Oct. 28, 1998

Related U.S. Application Data

[60] Provisional application No. 60/063,436, Oct. 29, 1997.

[51] Int. Cl.[6] ..... B41F 13/10

[52] U.S. Cl. ..... 101/375; 101/479

[58] Field of Search ..... 101/479, 389.1, 101/401.1, 375, 376; 492/21

[56] References Cited

U.S. PATENT DOCUMENTS

| | | | |
|---|---|---|---|
| 1,230,190 | 6/1917 | McIndoe et al. | 101/378 |
| 3,590,452 | 7/1971 | Macleod | 101/375 |
| 3,693,544 | 9/1972 | Trzyna | 101/110 |
| 4,197,798 | 4/1980 | Bardin | 101/153 |
| 5,904,095 | 5/1999 | Nelson | 101/375 |

*Primary Examiner*—Edgar Burr
*Assistant Examiner*—Daniel J. Colilla
*Attorney, Agent, or Firm*—Jacobson & Johnson

[57] ABSTRACT

A printing plate cylinder having a hollow cylindrical bore is mounted to a tapered rotatable drive shalt by an adapter having a tapered bore for engaging the drive shalt and a cylindirical outer surface with a flange having guide pins for mating with linear bearings mounted on the printing plate cylinder.

6 Claims, 3 Drawing Sheets

13
15
12
14
17
18
14
18
24
24
22
10
23
14
14
19
25

GUIDE PIN MOUNTING FOR A PRINTING PLATE CYLINDER

This application claims the benefit of U.S. Provisional Application No. 60/063,436 filed Oct. 29, 1997.

FIELD OF THE INVENTION

This invention is directed toward providing means for mounting a printing plate cylinder, for example a magnetic cylinder, to a rotatable drive shaft. More specifically, the invention is aimed at providing means for mounting the printing plate cylinder such that it can be removed and replaced without requiring substantial realignment or reregistration. Even more specifically, the invention is aimed at mounting a printing plate cylinder to a tapered rotatable drive shalt.

DESCRIPTION OF THE PRIOR ART

Printing plate cylinders or drums are well known in the art. A printing plate is wrapped completely or partly around the cylinder or drum and clamped in place. In some instances the plate is held in place by mechanical clamps and in other instances the printing plate cylinder is magnetic and the printing plate is held in place by magnetic force. In some cases the printing plate cylinder includes a shaft which is coupled to a driving source for rotatably driving the cylinder and in other instances the printing plate cylinder has a hollow bore which is then slipped over the energy-providting drive source shaft. Each time the cylinder is uncoupled from and replaced on the drive shaft it generally goes out of registration with respect to the rest of the printer and usually requires somewhat lengthy and arduous effort to adjust it back into alignment. It has been found that by using a tapered drive shaft with a conresponding mating tapered bore in the printing plate cylinder substantially accurate alignment is retained even though a cylinder is removed from and then replaced, or a new cylinder placed, on the shaft. Howvever, there are serious drawbacks with tapered shafts. For one, it is difficult to remove a cylinder from a tapered drive shaft because of the tight fit. Even in cases where the drive shalt is not tapered but made to fit tightly onto the cylinder bore in order to retain alignment each time the drum is removed and replaced, removal and replacement of the cylinder is diflicult because of the tight fit. Also, there can be some scoring or wear on the shaft and/or the bore of the cylinder which then results in loss of the accuracy of the alignment.

SUMMARY OF THE INVENTION

A printing plate cylinder is constructed in a certain fashion and is used in conjunction with an adapter to mount it to a tapered rotatable drive shaft. The adapter is in the form of a sleeve-like member which has a bore which can be coupled or mounted to a tapered drive shaft and has an outward extending flange at one end which has guide pins extending in an axial direction circumferentially spaced on the flange and another set of guide pins extending axially circumferentially around the other end of the sleeve member. The printing plate cylinder or drum has a hollow bore to slip over the sleeve member and at one end has circumferentially spaced recesses containing linear bearings for receiving and mating with the guide pins on the flange of the sleeve member and at its other end an inwardly extending ring or flange also having circumferentially spaced recesses or openings for receiving and mating with the other set of guide pins on the sleeve member. In this fashion, then, the printing plate cylinder can be removed from the adapter merely by moving the cylinder in an axial direction to disengage the guide pins from their corresponding recesses and the same or another printing plate cylinder replaced on the adapter. When back in place the registration of the printing plate cylinder is virtually unchanged.

In the preferred form the adapter is made of two parts. An internal member has a tapered hollow bore for tightly mating with the tapered shaft and has a cylindrical outer surface with ballbearings. An outer sleeve member is mounted on the bearings over the internal member. The reason for the ballbearings is to allow some rotation or circumferential adjustment of the sleeve member if necessary. The printing plate cylinder can be removed and replaced quite easily on the adapter without any significant change in alignment or registration. However, if some fine tuning is necessary it can be done by conventional means in adjusting the adapter sleeve member with respect to the inner member which is tightly engaged with the drive shaft.

DESCRIPTION OF THE PREFERRED EMBODIMENTS

Figure 1:
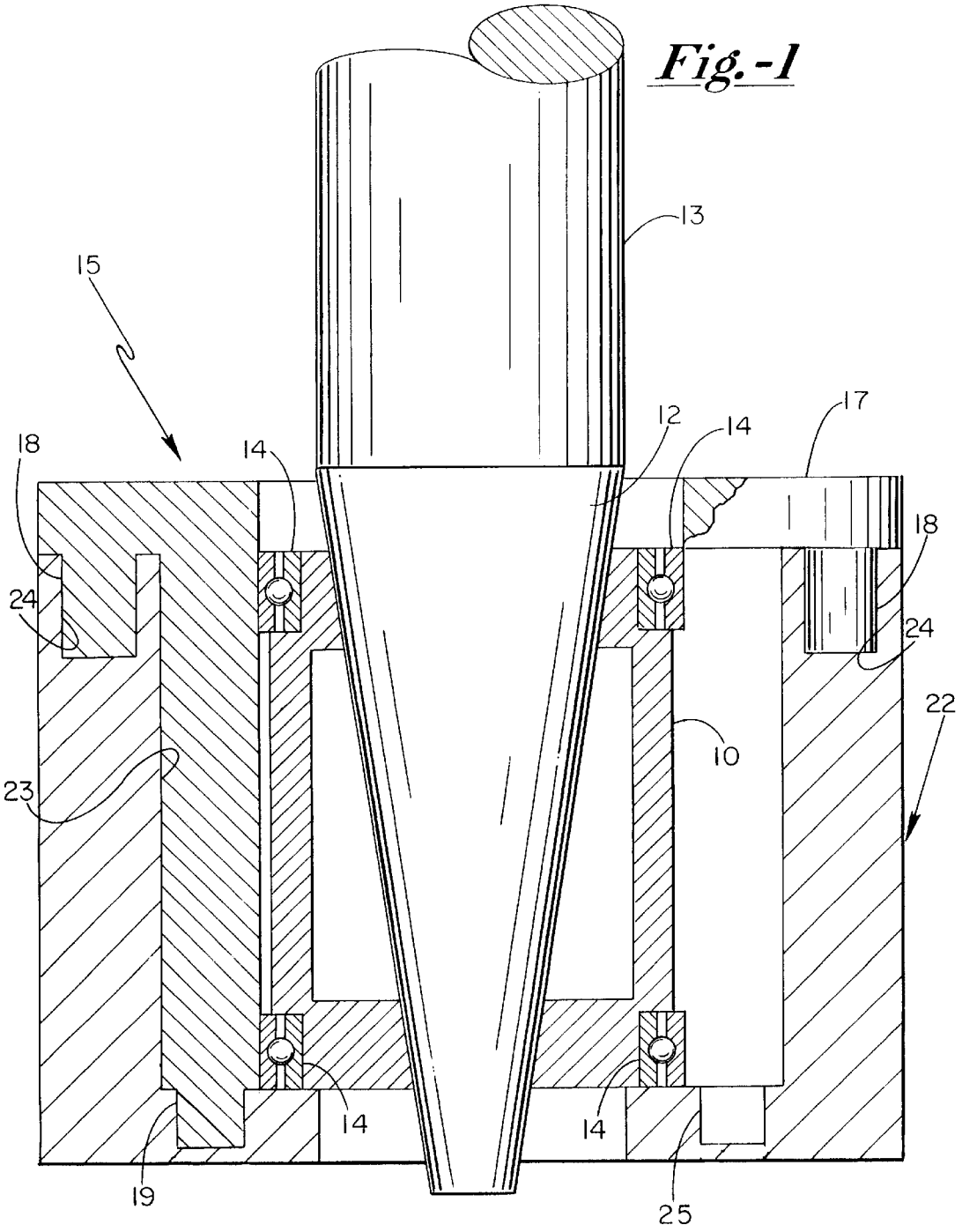
FIG. 1 is a section view of a preferred embgodiment of the invention.
Figure 2:
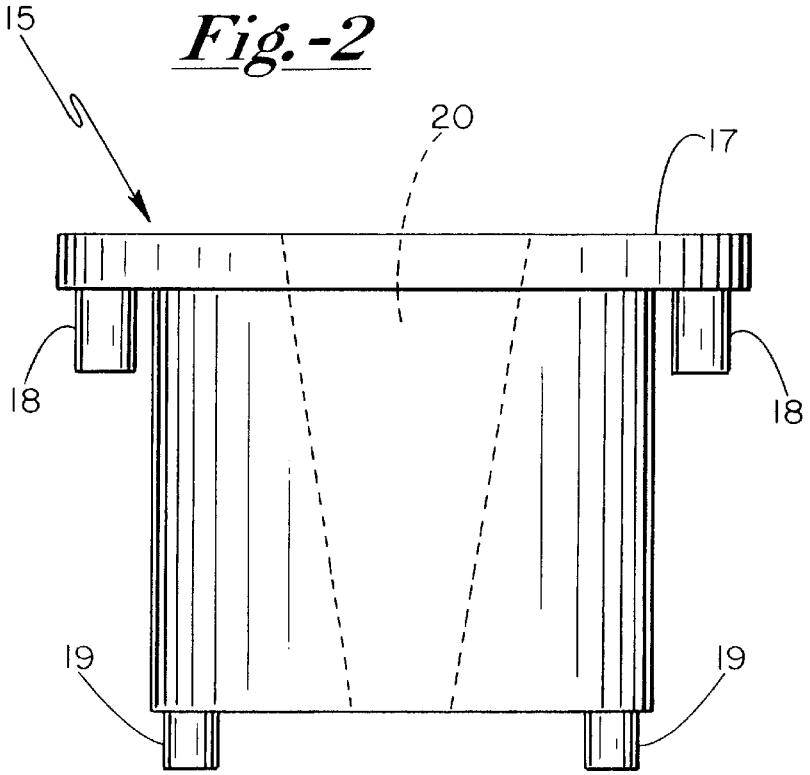
FIG. 2 is a side view of a sleeve member utilized in an alternate embodiment.

A cylindrical inner member 10 has a tapered bore 11 for mating with the tapered end 12 of a rotatable drive shaft 13. Mounted on the outside of member 10 near each end are sets of ballbearings 14. A sleeve member generally designated by reference numeral 15 has a circular axial bore 16 engaging the outside of inner member 10 resting on ballbearings 14. At one end, the upper end as viewed in FIG. 1, sleeve member 15 has an outer extending ring or flange 17 with a set of guide pins or rods 18 extending forward (or downward as viewed in FIG. 1) in an axial direction. In one embodiment there are four equally circumferentially spaced guide pins 18. At the other end of sleeve member 15 is another set of guide pins 19 similarly extending forward in an axial direction and preferably being four in number and similarly being equally circumferentially spaced. FIG. 2 illustrates an alternate form of sleeve member 15 in which the sledge member has a tapered bore 20 for making direct engagement with the tapered end 12 of shaft 13. In this form guide pins 18 and 19 would be the same as illustrated in FIG. 1.

Figure 3:
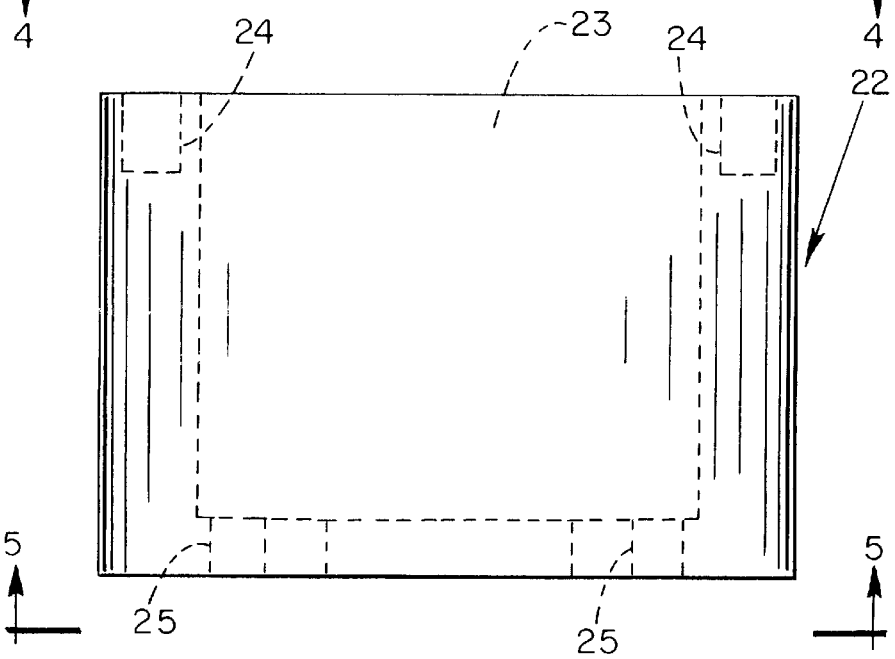
FIG. 3 is a side views of a printing plate cylinder utilized in the invention.
Figure 4:
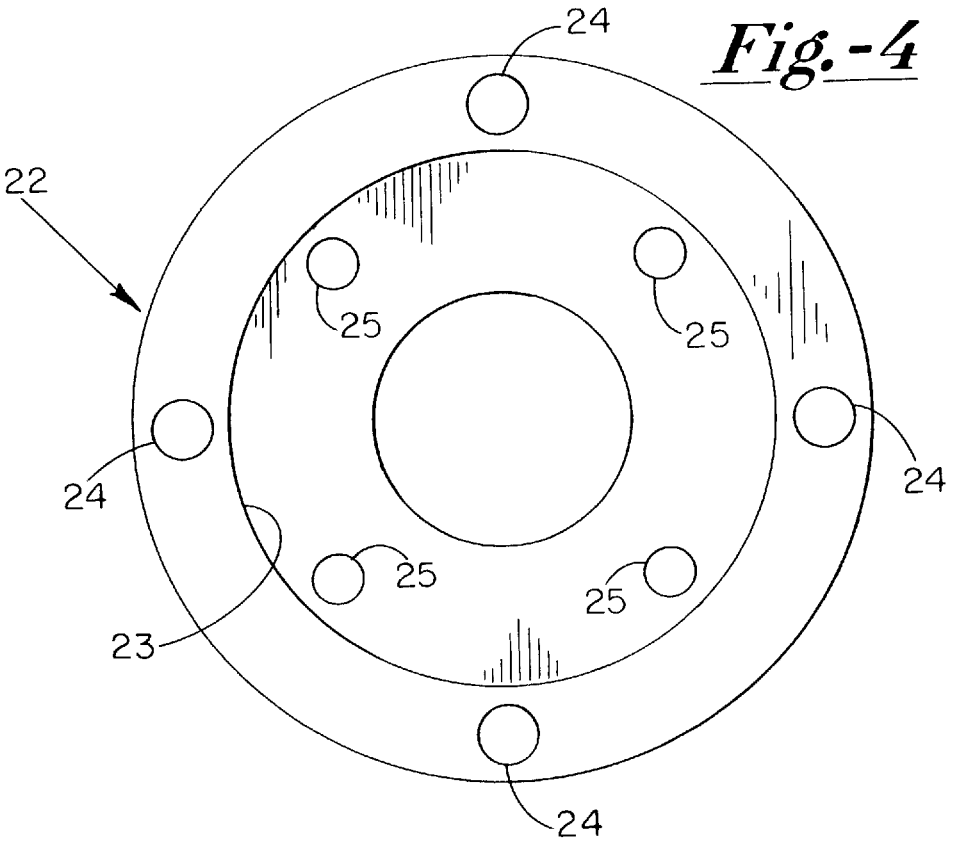
FIG. 4 is a view of one end of the printing plate cylinder.
Figure 5:
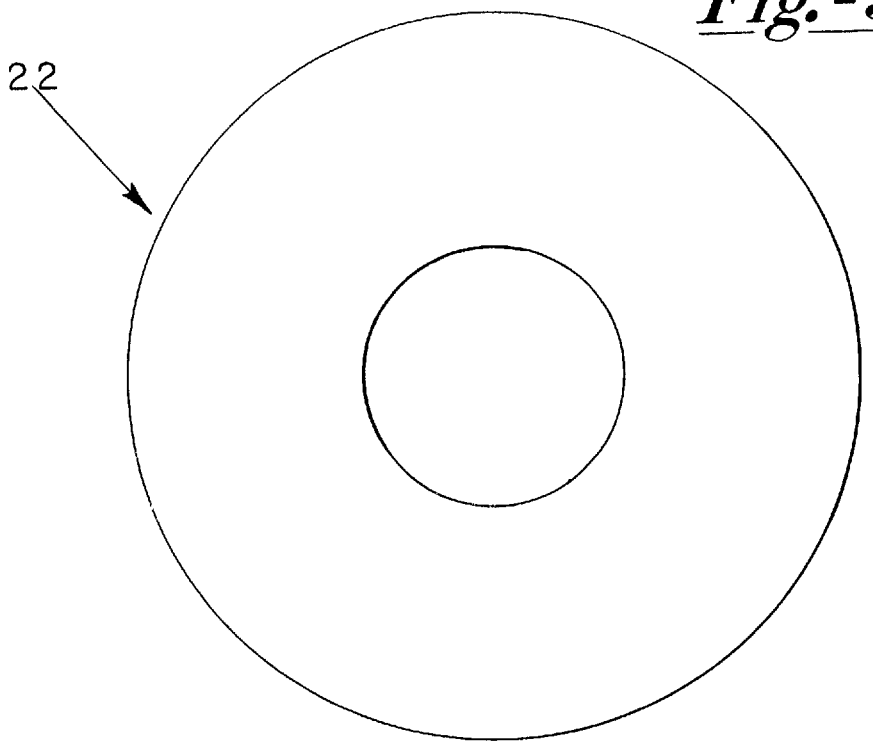
FIG. 5 is a view of the other end of the printing plate cylinder.

The printing plate cylinder 22, preferably a magnetic cylinder, has a cylindrical bore 23 which engages the outer circumference of the body of sleeve 15. At one end, the end closest to flange or ring 17, cylinder 22 has a series of recesses or openings 24 (FIG. 3) which are located to be aligned opposite guide pins 18 and at the end of bore 23 is another set of recesses or openings 25 which arc located to align with guide pins 19 on sleeve member 15. Recesses or openings 24 and 25 may contain linear or sleeve bearings (not shown) which are dimensionally selected to firmly yet removably seat guide pins 18 and 19, respectively. Guide pins 18 and 19 may be the same dimensions and correspondingly the bearings would be selected to be suitable dimensioned to seat snugly in openings 24 and 25 and to receive and removably hold in accurate alignment the corresponding guide pins 18 and 19. In this fashion, then, magnetic cylinder 22 is slipped over sleeve member 15 so that the guide pins 18 and 19 slide smoothly into their corresponding openings 24 and 25. Since sleeve member 15 can be accurately positioned on shaft 13 and is not moved when plate cylinder 22 is removed, the registration upon replacing the plate cylinder remains virtually intact because of the action of the guide pins 18 and 19 in the respective recesses or openings 24 and 25. Conventionally the printing press in which the printing plate cylinder is used ordinarily has adjustments which can be made fairly easily in order to fine tune the alignment, that is to bring it into perfect registration.

Alternatively, the adapter may be a single unit, i.e., sleeve member 15 and inner member 10 are combined as a single body. This eliminates bearings 14 so the unit would not have circumferential adjustability. This ordinarily can be compensated for by other means.

Linear bearings which might be used in recesses 24 and/or 25 are commercially available, for example from Linear Rotary Bearings, Inc., 215 Adams Street, P.O. Box 359, Bedford Hills, N.Y. 10507-0359. The linear bearings come in a variety of dimensions as far as the outer diameter, length, working bore and other factors which come into the design and use and application of the bearings. This is a matter of choice which will depend upon a number of factors in the design of the printing plate cylinder including the size, the nature of the material, the speed of operation of the printing press, etc. Linear bearings offer unlimited linear and rotary antifriction motion. Details of the features of the linear bearings and the construction, function and operation can be found in a catalog No. 94–101 obtainable from the aforementioned source of the bearings. Alternatively, accurately dimensioned sleeve bearings may also be used.

The invention as described herein may also be used on cylinders for holding die-cutting plates.

I claim:

1. For mounting a printing plate cylinder to a rotatable printing press drive shaft, in combination:

a) a cylindrical sleeve having an axial bore for coupling to a printing press rotatable drive shaft;

b) an outward extending circular flange at one end of said sleeve with a series of guide pins extending in an axial direction circumferentially spaced along said flange;

c) a series of guide pins extending in an axial direction circumferentially spaced on the other end of said sleeve; and d) an annular printing plate cylinder having an axial bore for engaging said sleeve, said plate cylinder having openings at one end adaptable for mating with the guide pins on the sleeve flange and an inward extending circular flange at the other end with openings adaptable for mating with the guide pins on the other end of said sleeve.

2. The combination as described in claim 1 wherein said sleeve is coupled to the drive shaft by an inner annular cylindrical member, said inner member having a bore for securing said inner member to the drive shaft, the bore of said cylindrical sleeve engaging the outside of said inner member.

3. The combination as described in claim 1 wherein the openings in said plate cylinder contain bearings for engaging corresponding guide pins on said sleeve.

4. The combinations as described in claim 2 further including outer bearings on said inner member, said sleeve resting on s aid outer bearings.

5. The combination as described in claim 1 wherein the axial bore of said sleeve is tapered directly engaging tapered drive shaft.

6. The combination as described in claim 2 wherein the bore of said inner annular cylindrical member is tapered for engaging a tapered drive shaft.

* * * * *